US005308449A

United States Patent [19]

Fuentes et al.

[11] Patent Number: 5,308,449

[45] Date of Patent: * May 3, 1994

[54] METHOD FOR TREATING A PAPER PULP WITH AN ENZYME SOLUTION

[75] Inventors: Jean-Luc Fuentes, Villenave d'Ornon; Michel Robert, Lacanau, both of France

[73] Assignee: La Cellulose du Pin, Bordeaux, France

[ * ] Notice: The portion of the term of this patent subsequent to May 8, 2007 has been disclaimed.

[21] Appl. No.: 915,879

[22] Filed: Jul. 20, 1992

Related U.S. Application Data

[63] Continuation of Ser. No. 769,349, Oct. 2, 1991, abandoned. which is a continuation of Ser. No. 443,439, Nov. 30, 1989, abandoned, which is a continuation of Ser. No. 99,786, Sep. 22, 1987, Pat. No. 4,923,565.

[30] Foreign Application Priority Data

Sep. 22, 1986 [FR] France ..... 86 13208

[51] Int. Cl.[5] ..... D21H 17/21

[52] U.S. Cl. ..... 162/72; 435/277; 435/278

[58] Field of Search ..... 435/277, 278, 917, 945; 162/1, 72, 157.6, 254, 263, 9, 10, 100

[56] References Cited

U.S. PATENT DOCUMENTS

| | | | |
|---|---|---|---|
| 3,041,246 | 6/1962 | Bolaski et al. | 162/157.6 |
| 3,406,089 | 10/1968 | Yerkes | 162/72 |
| 3,616,222 | 10/1971 | Dashinger | 162/72 |
| 3,972,775 | 8/1976 | Wilke et al. | 435/945 |
| 4,451,567 | 5/1984 | Ishibashi et al. | 435/945 |

FOREIGN PATENT DOCUMENTS 351655 1/1990 European Pat. Off. .

OTHER PUBLICATIONS

Rilon et al.; "Increasing Water Retention of Mechanical Pulps By Biological Treatments", *Tappi*, Jun. 1982, pp. 93–96.

McGill "Measurement and Control in Papermaking"; Adam Hilger Ltd, Bristol p. 238, 1980.

MacDonald et al. "Pulp and Paper Manufacture, Vol. II"; McGraw Hill Book Company, Sect. 9–46–9–48, 1969.

*Primary Examiner*—Steve Alvo

*Attorney, Agent, or Firm*—Oblon, Spivak, McClelland, Maier & Neustadt

[57] ABSTRACT

An enzyme preparation containing cellulases and/or hemicellulases is reacted on a homogeneous aqueous suspension of paper pulp having a Schopper-Riegler (SR) degree determined in accordance with standard NFQ 50 003 of at least equal to 25. A paper pulp based on recycled fibers is treated.

9 Claims, No Drawings

METHOD FOR TREATING A PAPER PULP WITH AN ENZYME SOLUTION

This application is a continuation of application Ser. No. 07/769,349, filed on Oct. 2, 1991, now abandoned, which is a continuation of application Ser. No. 07/443,439, filed on Nov. 30, 1989, now abandoned, which is a continuation of application Ser. No. 07/099,786, filed Sep. 22, 1987, now U.S. Pat. No. 4,923,565.

BACKGROUND OF THE INVENTION

1. Field of the Invention

The present invention relates to the papermaking industry and in particular to the recycled paper, industry. More specifically, its object is a new method for treating paper pulps using an enzyme solution.

2. Background of the Prior Art

More and more the papermaking industry uses recycled papers. For example, for the manufacture of corrugated cardboard, more and more often raw materials are used which are based on recycled fibers and, at the same time, the number of recyclings is increased. With each recycling, the quality of the raw materials is lessened. To obtain a satisfactory level of mechanical characteristics, refining of the pulps in an aqueous suspension is generally carried out, which leads to difficulties in machinability.

The pulps in aqueous suspension which are ready to be worked on a paper machine can be characterized by various parameters, one of which is particularly significant for predicting the draining capability of the pulp. Thus, the Schopper-Riegler (SR) degree of a pulp is defined as being an element of appreciation of the quality of a pulp for the manufacture of paper. The SR expresses the capability of water to separate from the suspension under conditions defined by standard NFQ 50 003. On a scale going from 0 to 100; a high SR value means a low suspension draining speed whereas a low value means a more rapid draining speed. It has been noted, for example, that a pulp which has undergone a refining- operation has an SR which is more or less increased depending on the degree of refining to which it has been subjected, as compared to a pulp which has not undergone or has only slightly undergone such an operation.

This parameter plays a particularly important role in the yield of the paper machine. In effect, in order to increase the yield, the draining phase must take as little time as possible. For suspensions with a high SR, it is necessary to increase the concentration of the pulps in order to maintain the same manufacturing rate. This causes poorer sheet formation since the fibers are more difficult to distribute. It is therefore particularly advantageous to have suspensions with a fairly low SR.

It is considered that when the suspensions have an SR of greater than 25, it becomes desirable to attempt to lower it in order to improve the paper manufacturing conditions. Such a lowering is desirable for two reasons: on the one hand, the yield on the paper machine can be improved due to the acceleration of the draining; on the other hand, the rates of manufacture can be maintained without having to compensate for the slowness of the draining with a lesser dilution of the suspension, and with the risks that such would cause poor sheet formation.

The invention seeks to provide a method for treating papermaking pulps in aqueous suspension, such as suspensions based on recycled fibers, having an SR at least equal to 25 which, through the use of enzymes, enables the SR to be lowered and therefore improves the draining of the suspension and the yield of the method for forming the paper.

In the papermaking industry a certain number of methods are known which call for enzyme preparations.

For example, from French Patent FR 2,557,894, a method is known for treating papermaking pulps with an enzyme solution which assists the refining of the pulp, and renders it capable of being transformed into a paper having defined characteristics. In accordance with this method, a particular enzyme solution containing xylanases is reacted on an unrefined pulp which, therefore, has a fairly low SR on the order of 10.

This method seeks, therefore, not to improve the draining of the treated pulp, but to improve its capability of being refined.

From Canadian Patent CA 758,488, a method is also known for refining a papermaking pulp which consists of submitting an unrefined pulp to the action of an enzyme solution which is based in particular on cellulase, pectinol or lipase, and of submitting it simultaneously to mechanical refining. The object sought is also the improvement of the refinement of the treated pulp.

From French Patent FR 2,571,738, a method is also known for treating a papermaking pulp in accordance with which, with a view to providing the pulp with the characteristics of a pulp for chemical usage, an enzyme preparation containing fungic cellulases having a $C_1$ activity and a $C_x$ activity is introduced to the pulp.

SUMMARY OF THE INVENTION

The method in accordance with the invention is applied not to unrefined papermaking pulps, but to pulps which already have a high SR. The high value of the SR can result either from prior mechanical refining which has rendered the pulp able to provide a paper with good mechanical characteristics, or due to the fact that the pulp has already undergone several recyclings, or possibly from the combination of the two operations.

In accordance with the invention, an enzyme preparation containing cellulases and/or hemicellulases is reacted on a papermaking pulp with an SR at least equal to 25, measured on a pulp in a homogeneous suspension at 2 g/l under the conditions of standard NFQ 003.

It has been noted that such treatment enables the SR of the treated pulp to be lowered while at the same time having no undersirable effect on the mechanical characteristics of the papers manufactured from such pulp.

The treated papermaking pulps can be intended for the most varied uses in the papermaking field. They are pulps based on recycled fibers or natural or bleached chemical pulps for providing kraft papers. Mechanical pulps can also be cited, such as those used for the manufacture of newspaper.

DETAILED DESCRIPTION OF THE INVENTION

Among all the enzyme preparations containing cellulases and/or hemicellulases, those which possess a $C_1$ activity, a $C_x$ activity and a xylanase activity are preferably selected. Without knowing the exact role played by each of these activities, it would seem that the combination of three leads to the desired effect. These three activities are defined by the international nomenclature for enzymes and they can be qualified and expressed in units of the international system by milligram of powder of the enzyme preparation under consideration. The $C_1$ activity is the action of cellobiohydrolase able to be determined on pure very organized cellulose. This activity is manifested by the production of cellubiose and the international system uses the AVICEL substrate as the reference substrate. The $C_x$ activity is determined on modified cellulose, carboxymethylcellulose, and it is quantified by a drop in the viscosity of the carboxymethylcellulose or an increase in reductive activities. The xylanase activity enables a hydrolysis of the bonding xylanes.

The treatment with the enzyme preparation is preferably not pursued for more than approximately 60 minutes, since the SR tends to rise slightly after such a period, although still remaining considerably lower than the starting SR.

The concentration of enzymes in the enzyme preparation used varies in accordance with the $C_1$, $C_x$ or xylanase activities of the enzymes contained in the preparation. Thus, the enzyme preparation is preferably at a concentration of 0.01% to 2% of the weight of the dry pulp, with said percentages corresponding to a preparation having a $C_1$ activity of 0.168 USI per milligram of powder, a $C_x$ activity of 3.9 USI per milligram of powder and a xylanase activity of 31 USI per milligram of powder.

It goes without saying that the concentrations of the enzyme preparations must be adapted depending on the type of preparation used. Nevertheless, generally, with less than a concentration of equal to approximately 0.01% of the weight of the dry pulp, no significant effect is observed other than prolonging the reaction time. With more than a concentration equal to approximately 2% of the weight of the dry pulp, the cost of the operation tends to become prohibitive, and the mechanical characteristics of the paper manufactured tend to be lower.

The reaction medium can be controlled for the action of the enzymes. Temperature and pH conditions are more particularly appropriate to prevent any risk of the medium denaturing the enzymes. The pH is therefore preferably between 3 and 7 and the temperature between 20° C. and 60° C. Above 60° C., the medium tends to denature the enzyme, and below 20°, the action of the enzymes takes place particularly slowly.

A good example of the use of the method in accordance with the invention is represented by the pulps in a suspension based on recycled fibers. The treatment in accordance with the invention provides a substantial improvement in the yield on the paper machine. In accordance with a particularly preferred embodiment of the invention, such an application of the enzyme treatment is preceded by conventional mechanical refining. It has been noted that, under these conditions, the mechanical characteristics of the manufactured paper, and in particular the burst index or the CMT, were also improved.

For all the pulps which lead to the formation of papers whose mechanical characteristics are considered insufficient, a coating with starch is preferably carried out after the formation of the sheets and drying on the paper machine. Under these conditions, not only is a lowering of the SR obtained due to the enzyme treatment, but also there is an increase in the mechanical characteristics such as the burst index or the CMT due to the coating with starch.

After the enzyme treatment, the pulp in suspension is worked on a conventional paper machine which comprises a manufacturing table provided with a chamber providing a jet of pulp in aqueous suspension for the formation of a sheet of paper with one layer, which manufacturing table is covered with a canvas for the drainage of the pulp, a press section, a drying section and possibly a size press for the starch coating.

Other characteristics and advantages of the invention will become apparent from the following detailed description of examples of embodiments.

In all the reported examples, the indicated characteristics are defined in the following manner:

Schopper-Riegler degree (SR): in accordance with the standard NFQ 50 003 (measured on a pulp in a homogeneous suspensions at 2 g/l).

Burst index: in accordance with standard NFQ 03 053, it is quantified by the quotient of the maximum uniformly distributed pressure, and supported by a paper test piece, perpendicularly to its surface, by the gram weight of the paper, CMT (Corrugated medium test): the indicated value translates the resistance to flat compression of a ribbed paper and constitutes an index of edgewise compression. The test is carried out in the following manner: the paper is compressed after having been conditioned for 60 minutes.

$$\text{The index} = \frac{CMT_{60}\ (\text{expressed in kg}) \times 100}{\text{gram weight g/m}^2}$$

EXAMPLE 1

An aqueous suspension of papermaking pulp based on recycled fibers was prepared in the following manner: 5 kg was weighed cry of a pulp composed of 40% of fibers from recycled cardboard cartons (RCC) and 60% of fibers from bulk stock and this was placed in a reactor. From this was made a 3.5% by weight aqueous suspension by adding water up to a total weight of 143 kg. The pH of the suspension was adjusted to 4.8 by adding 900 cc of $H_2SO_4$ 1N. The reactor was stirred at a speed of 50 rpm to homogenize the suspension. The reactor was preheated for 90 minutes until it reached 50° and then 0.1% by weight in relation to the weight of the dry pulp of enzymes were introduced which had been prepared in the following manner: 5 g of a Maxazyme CL 2000, sold by the RAPIDASE company, were taken. The product sold under this name is characterized by the fact that it comes from the culture of the *Trichoderma viridae* microorganism and that it has a $C_1$ activity of 0.168 USI, a $C_x$ activity of 3.91 USI, a xylanase activity of 31 USI and an FPU (Filter paper unit) of 0.28. This powder was placed in 2800 g of water brought to a pH of 4.8 and the aqeous solution of enzymes prepared in this manner was introduced into the reactor. The maxazyme was left to react for 30 minutes.

The reaction was stopped by diluting the contents of the reactor until a suspension with 7 g liter was obtained.

The SR was measured for this example just before the introduction of the enzymes and 30 minutes after the introduction of the enzymes. Its value went from 54 to 44.

At the same time and under identical conditions, a reference suspension was prepared which was not treated with the enzyme solution and the suspensions were sent to a pilot paper machine to form a one-layer sheet with a gram weight of 120 g/m$^2$.

The following mechanical characteristics were noted:

| | Reference | Example 1 |
|---|---|---|
| Burst index | 1.83 | 1.84 |
| C M T | 129 | 124 |

It was observed that the treatment did not deteriorate the mechanical characteristics.

EXAMPLE 2

The conditions of Example 1 were repeated, except that before the introduction of the enzymes, the pulp in suspension was refined mechanically using a SPROUT-WALDRON refiner until an SR of 74 was obtained. 30 minutes after the introduction of the enzymes, the SR had gone down to 59.

The following mechanical characteristics were noted:

| | Reference | Example 2 |
|---|---|---|
| Burst index | 1.83 | 2.07 |
| C M T | 129 | 141 |

A considerable improvement was therefore observed in the mechanical characteristics, whereas the negative effects of the mechanical refining on the value of the SR were compensated. For a final SR (59) approximately identical to the inirial SR (54), the mechanical characteristics of the manufactured paper had been increased.

EXAMPLE 3

The conditions of Example 1 were repeated, except that after having formed the sheet of paper it was coated with starch in an amount of 5 g/m$^2$ using a size press.

The reference was coated with starch but was not treated with the enzymes.

The following mechanical characteristics were noted:

| | Reference | Example 3 |
|---|---|---|
| Burst index | 2.8 | 2.65 |
| C M T | 161 | 164 |

It was noted that a high level of mechanical characteristics were maintained. In comparison with the reference of Example 1, the treatment carried out under the conditions of Example 3 therefore enabled not only the lowering of the 3R but also an increase in the mechanical characteristics.

EXAMPLE 4

The conditions of Example 2 were repeated while subjecting the paper to the starch treatment described in Example 3.

The following mechanical characteristics were noted.

The reference had been coated with starch but not treated with the enzymes nor mechanically refined.

| | Reference | Example 4 |
|---|---|---|
| Burst index | 2.9 | 2.82 |
| C M T | 161 | 174 |

An even more considerable improvement of the mechanical characteristics was observed than that observed in Example 3.

EXAMPLE 5

The conditions of Example 1 were repeated, except that the maxazyme CL 2000 was replaced with cellulase 250 P sold by the GENENCOR company. This liquid enzyme preparation is characterized by the following activities:

| | |
|---|---|
| $C_1$ (AVICEL) | 0.008 USI/mg of powder |
| $C_x$ (CMC) | 0.12 USI/mg of powder |
| Xylanase | 0.11 USI/mg of powder |
| FPU | 0.26 USI/mg of powder |

The starting papermaking pulp was also modified. This time it was composed of 75% CCR and 25% bulk stock and it was made into an aqueous suspension at 3%.

The SR went from 39.5 to 29.5.

The following mechanical characteristics were noted:

| | Reference | Example 5* |
|---|---|---|
| Burst index | 1.76 | 1.65 |
| C M T | 98.7 | 92.3 |

*measurements carried out on a small laboratory form at 120 g/m$^2$ airconditioned at 23° C. with 50% relative humidity.

EXAMPLE 6

The conditions of Example 5 were repeated, replacing the cellulase 250 P with the SP 249 enzyme preparation derived from the *Aspergillus niger* microorganism and sold by the NOVO company.

This liquid enzyme preparation is characterized by the following activities:

| | |
|---|---|
| $C_1$ (AVICEL) | 8 USI/mg of powder |
| $C_x$ (CMC) | 108 USI/mg of powder |
| Xylanase | 560 USI/mg of powder |
| FPU | 1 USI/mg of powder |

This preparation was introduced at a concentration of 2.65% of the weight of the dry pulp.

The SR went from 34.5 to 27.

The following mechanical characteristics were noted:

| | Reference | Example 6 |
|---|---|---|
| Burst index | 2 | 1.95 |
| C M T | 127 | 125 |

It was noted that the mechanical characteristics were maintained.

EXAMPLE 7

Under the same conditions as Example 1, an aqueous suspension was prepared with 5% of a papermaking pulp composed of 100% bulk stock. This time, 0.25% by weight of dry pulp of the enzyme preparation of Example 1 was introduced.

The SR went from 48 to 35.5.

Suitable mechanical characteristics were observed.

EXAMPLE 8

A chemical kraft pulp of short bleached fibers was prepared from which a 5% suspensions was made. The method used was that described in Example 1 except that the enzyme preparation was introduced at a concentration of 0.25% by weight of dry pulp and the enzymes were reacted for 60 minutes.

Before the enzyme treatment, the pulp was refined mechanically so that the SR went from 18 to 25. After the enzyme treatment, it was noted that the SR had been lowered to 20.

For chemical pulps, mechanical characteristics other than those used for the pulps composed of recycled fibers are significant due to the different qualities which are required of the paper.

The burst index is still used together with the length of rupture by traction.

The length of rupture by traction is determined in accordance with the conditions defined in standard NFQ 03 004. It is the calculated limit of length beyond which a band of paper of any uniform width supposedly suspended by one of its ends breaks under the effect of its own weight.

The following mechanical characteristics were noted:

| | Reference | Example 8 |
|---|---|---|
| Burst index | 1.29 | 1.28 |
| Length of rupture (m) | 2535 | 2546 |

In relation to the reference, it was noted that the mechanical characteristics were maintained.

EXAMPLE 9

The same conditions as in Example 8 were repeated, except that the pulp was mechanically refined in advance until an SR of 31 was obtained. After the enzyme treatment, the SR was lowered to 22.

The following mechanical characteristics were noted:

| | Reference | Example 9 |
|---|---|---|
| Burst index | 1.40 | 1.45 |
| Length of rupture (m) | 2800 | 2820 |

In relation to Example 8, it was noted that when starting with a higher initial SR, corresponding to a more refined pulp, whose use leads to the manufacture of papers with better mechanical characteristics, by means of the invention the SR was more easily able to be lowered without, however, deteriorating the mechanical characteristics. Therefore, not only are there satisfactory mechanical characteristics but there is also a good yield on the paper machine. In Example 8, the SR was lowered from 25 to 20 after the enzyme treatment, which is a drop of 20%. In Example 9, the SR was lowered from 31 to 22 after an identical enzyme treatment, which is a drop of 29%.

EXAMPLE 10

A chemical kraft pulp with long bleached fibers was prepared, from which a 5% suspension was made. The conditions were identical to those of Example 8, except that the pH of the medium was adjusted to 6 and the temperature was brought to 20° C.

The initial SR was 12 and the pulp underwent a mechanical refinement prior to the enzyme treatment which brought the SR to 25. After the enzyme treatment, it was lowered to 21.

It was therefore noted that by modifying the temperature and pH conditions, the action of the, enzymes was not inhibited.

The following mechanical characteristics were noted:

| | Reference | Example 10 |
|---|---|---|
| Burst index | 4.74 | 4.58 |
| Length of rupture (m) | 5173 | 5052 |

As compared to the mechanically refined reference which was not treated with the enzymes, it was noted that the level of mechanical characteristics was maintained. The higher values of the rupture length of the reference and of the example were due to the fact that the pulp comprised long fibers and not short fibers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method for treating a papermaking pulp for use with a conventional paper machine to make a sheet of paper, with an enzyme preparation, comprising treating a homogeneous aqueous suspension of said papermaking pulp having a Schopper-Riegler degree (SR) determined in accordance with standard NFQ 50 003 of at least equal to 25 prior to treatment with an enzyme preparation containing an enzyme selected from the group consisting of cellulases, hemicellulases and mixtures thereof using a concentration of said enzyme suitable to thereby obtain a lowering of the SR degree and improve the suspension's drainability while at the same time having no undesirable effect on the mechanical characteristics of paper manufactured from such pulp.

2. The method in accordance with claim 1, wherein an enzyme preparation is used which contains enzymes derived from the *Trichoderma viridae* microorganism.

3. The method in accordance with claim 1, wherein an enzyme preparation is used which contains enzymes derived from the *Aspergillus niger* microorganism.

4. The method in accordance with claim 1, wherein the treatment with the enzyme preparation is carried out for a period of time not more than 60 minutes.

5. The method in accordance with claim 1, wherein the treated suspension has a pH of between 3 and 7.

6. The method in accordance with claim 1, wherein the treated mixture is brought to a temperature of between 20° C. and 60° C.

7. The method in accordance with claim 1, wherein the papermaking pulp composed of recycled fibers.

8. The method in accordance with claim 7, wherein, after the treatment with the enzyme preparation, the pulp is worked on a paper machine and the formed paper is coated with starch.

9. The method in accordance with claim 1, wherein the pulp is mechanically refined prior to the treatment with the enzyme preparation.

* * * * *